US006246374B1

(12) United States Patent
Perrotta et al.

(10) Patent No.: US 6,246,374 B1
(45) Date of Patent: Jun. 12, 2001

(54) PASSIVE FLIP RADIATOR FOR ANTENNA ENHANCEMENT

(75) Inventors: Alessandro Perrotta, Ft. Lauderdale; Markus B. Kopp, Deerfield Beach; Quirino Balzano, Plantation, all of FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/544,185

(22) Filed: Apr. 6, 2000

(51) Int. Cl.[7] ..... H01Q 1/24
(52) U.S. Cl. ..... 343/702; 455/90
(58) Field of Search ..... 343/702; 455/90

(56) References Cited

U.S. PATENT DOCUMENTS

| | | | |
|---|---|---|---|
| 4,313,119 | 1/1982 | Garay et al. | 343/702 |
| 4,940,992 | 7/1990 | Nguyen et al. | 343/803 |
| 4,992,799 | 2/1991 | Garay | 343/702 |
| 5,554,996 | 9/1996 | Chatzipetros | 343/702 |
| 5,561,436 | 10/1996 | Phillips et al. | 343/702 |
| 5,561,437 | 10/1996 | Phillips et al. | 343/702 |
| 5,572,223 | 11/1996 | Phillips et al. | 343/702 |
| 5,760,747 | 6/1998 | McCoy et al. | 343/728 |
| 5,995,052 * | 11/1999 | Sadler et al. | 343/702 |

* cited by examiner

*Primary Examiner*—Don Wong
*Assistant Examiner*—James Clinger
(74) *Attorney, Agent, or Firm*—Scott M. Garrett

(57) ABSTRACT

An antenna system includes a main antenna (16) and a parasitic element (18). The parasitic element (18) is rotatably coupled (24) to the main antenna (16), the antenna system being movable from a closed position to an open position, in which the main antenna (16) is coupled to the parasitic element (18) to cause the parasitic element (18) to operate as a passive radiator element and to radiate (32) along with the main antenna (34) to enhance the gain of the antenna system.

16 Claims, 2 Drawing Sheets

PASSIVE FLIP RADIATOR FOR ANTENNA ENHANCEMENT

TECHNICAL FIELD

This invention relates generally to antennas and more specifically, to antennas for use in portable communication devices.

BACKGROUND

Antennas used in portable communication applications typically have problems with sensitivity when worn on, or used near, the human body because of the loading effects associated therewith. Additional problems associated with antennas used in portable communication applications are the limitation on the size of the antenna and the undesirability of antennas protruding from the communication device. As the size of the antenna becomes smaller to accommodate a shrinking communication device, the efficiency of the antenna decreases.

Communication devices, such as a phone and/or radio combination and other handsets are often designed as small as possible in order to make the device more portable. In order to keep the handset small, features such as retractable antennas are incorporated into the handset so that the handset will not occupy as much space when inserted into a pocket. The challenge is then to optimize antenna performance while providing an ergonomically suitable solution for the user.

Accordingly, it is desired to provide an antenna that may be used in a communication device that avoids the detriments of prior antennas used for the same or similar applications.

DETAILED DESCRIPTION OF THE PREFERRED EMBODIMENT

Figure 1:
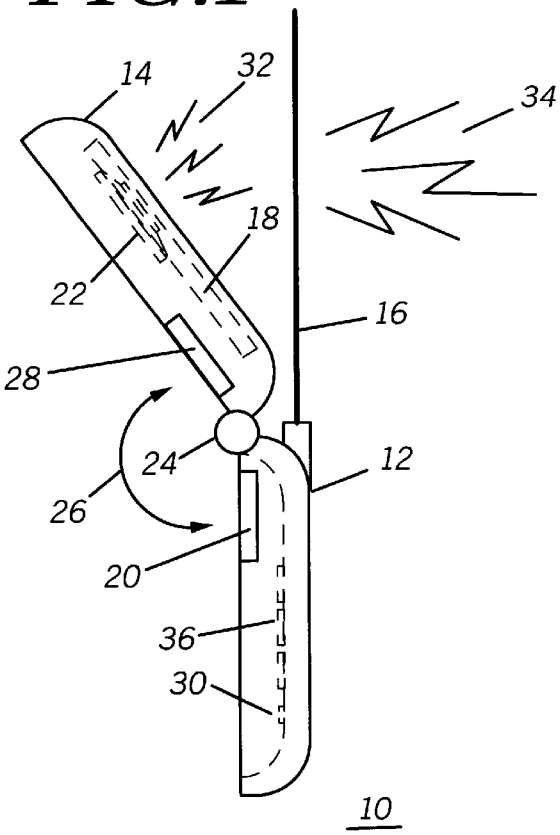
FIG. 1 is a cross-sectional side view of a portable communication device with an antenna array in the open position, in accordance with the present invention.

Referring to FIG. 1, there is shown a simplified cross-sectional view of the communication device 10, in the open position. The communication device 10 is a portable handset or wireless phone for the present application but can be any other type of electronic devices. The communication device 10 includes a first member or a main housing 12 and a second member or a flip or a flap 14 for the main housing, not necessarily shown in the actual proportionate relationship with each other. For example, the flip 14 is often much thinner and smaller than the main housing 12. In some applications, the second member may be a sliding or a planar rotating piece sliding or rotating away form the first member, respectively.

The second member 14 is rotatably attached to the first member by means of a hinge 24 (or any other hinge or rotational mounting means) in a clam-style arrangement. The communication device 10 is shown in an open position where the flip or second member 14 is positioned away from the housing or first member 12 at an obtuse angle 26 preferably within a range of 145 to 155 degrees for ergonomics or greater than 145 degrees for greater capacitive coupling of the antenna array consisting of a main antenna 16 and a parasitic element or radiator 18.

The main antenna 16 is attached to the first member 12 for vertical or angled extension at an acute angle, preferably between 15 and 35 degrees with the flip 14. The parasitic element or radiator 18 is attached to or disposed on the second member 14. In this embodiment, the two components of the antenna array, the main antenna 16 and the radiator 18, are not physically connected. They are, however, electromagnetically coupled to each other due to their substantially parallel arrangement. In the preferred embodiment, the two antenna components 16 and 18 radiate and receive simultaneously in the electric-field mode (i.e., they transmit and receive E field waves) and at the same resonating frequency. Alternatively, the main antenna 16 and the parasitic element 18 can resonate at two different frequencies, not too far apart, in case more of an impedance bandwidth is desired. The latter is necessary when an antenna for multimode products is desired. For instance, products operating at both the 800 MHz and 900 MHz range. Such products require that the antenna cover close to 200 MHz in bandwidth. This is very difficult to accomplish at such low frequencies due to the inherent bandwidth of the antenna topology and the size of the product. One approach to accommodate the increase in the bandwidth is to use a matching circuit, but these circuits do add losses to the signal path. A workable alternative is presented in the instant application. The ability to increase the bandwidth is becoming more and more common as portable communication devices tend to become more "world"-roaming capable.

Electrically, the incident electric field induces a current J to flow on the parasitic element 18 causing it to become excited and radiate to form an array system with the antenna 16. The flow of this current on the element 18 radiates back in the direction or beam 32 towards the antenna 16 in such a way that the two elements of the array 16 and 18 constructively interfere with one another. The parasitic element 18, when thus coupled with the main antenna 16, forms a new radiation pattern which represents the combination of the main antenna 16 and the parasitic element 18. This constructive combination is such that the radiated energy undergoes a change which allows an increase in the overall electric field magnitude in a direction opposite to the user. This very phenomenon improves the antenna overall efficiency. In addition, this constructive interference allows an improvement at the points in the radiation pattern where nulls are present in the case of a single element.

A display 20 and a keypad 36 are also located on the first member or housing 12. A speaker 22 and a transparent display screen 28 for allowing the display 20 to show through underneath, when the flip is collapsed or otherwise closed on top of the housing 12 (as in a closed clam-shell configuration), is contained in the second member 14. The speaker 22 is mounted within the second member 14 and a microphone 30 is mounted within the first member 12 so that persons using the communication device 10 may hold to their faces the side containing the exterior portions of the speaker 22 and of the microphone 30. A keypad 36 may be located on this same side of the communication device 10.

Signals 32 and 34 are radiated mostly in the direction shown by the arrow (i.e., they are unidirectional in a directed beam of an antenna array). This direction is intentionally away from the user in order to avoid the adverse loading effects the user presents to the signal. Analyzed from a different perspective, the parasitic radiator 18 also operates as an escape route for the highly excited currents from the speaker's wires or other audio lines connecting the speaker 22 on the flip 14 via the hinge 24 to the rest of the audio circuit in the main housing 12 PCB to flow into. This parasitic radiator 18 has also shown to reduce hand proximity effects when a users hand is holding the flip 14 and the housing 12. Therefore, the communication device 10 has the advantage over other communication devices in that it includes an antenna array which helps to improve the overall radiation and reduce the unwanted hand proximity effects.

Figure 2:
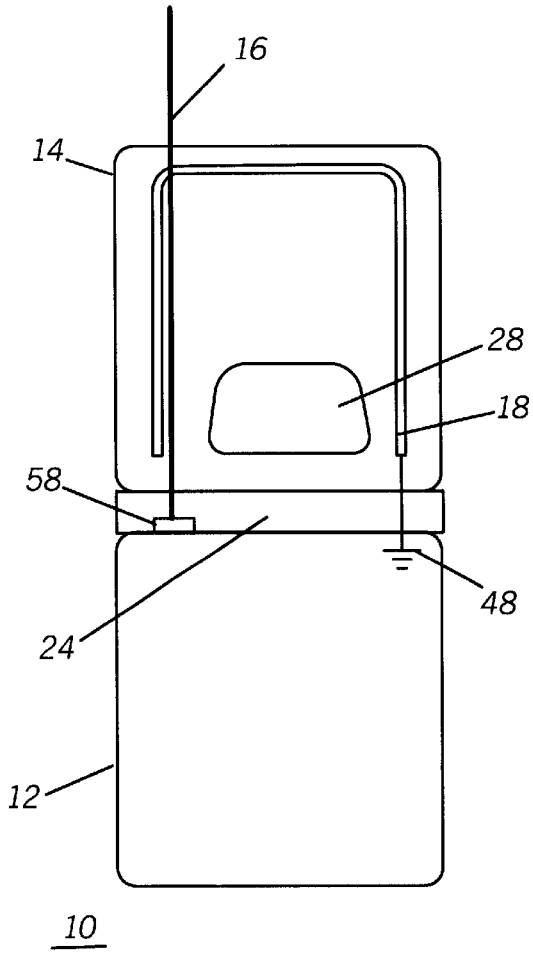
FIG. 2 is a back view of the communication device shown in FIG. 1, in accordance with the present invention.
Figure 3:
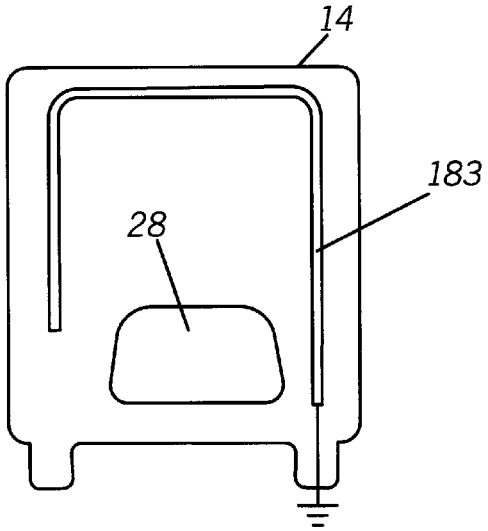
FIG. 3 is a representation of the flip 14 of FIG. 2 showing a second embodiment of the parasitic radiator 18.
Figure 4:
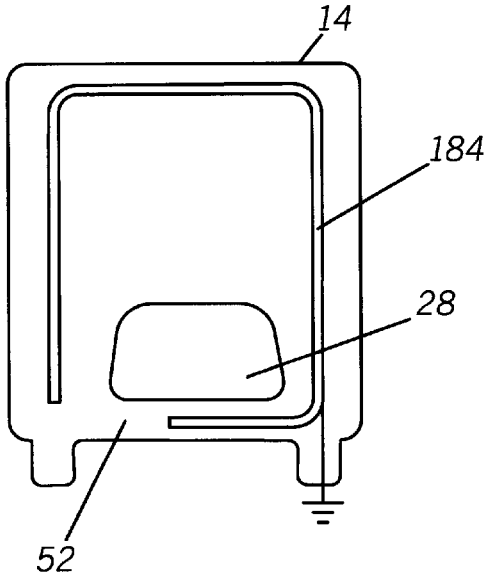
FIG. 4 is a representation of the flip 14 of FIG. 2 showing a third embodiment of the parasitic radiator 18.
Figure 5:
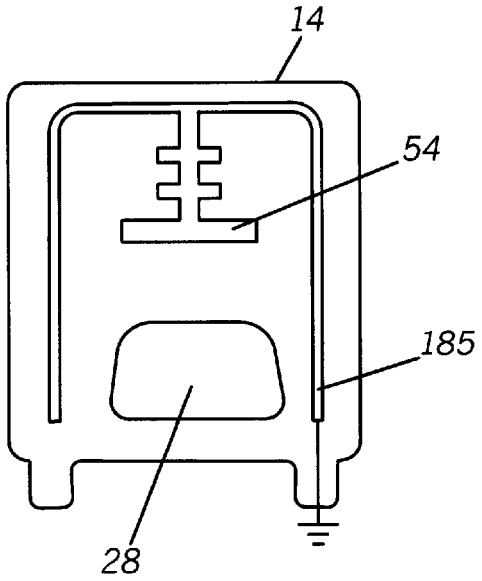
FIG. 5 is a representation of the flip 14 of FIG. 2 showing a fourth embodiment of the parasitic radiator 18.
Figure 6:
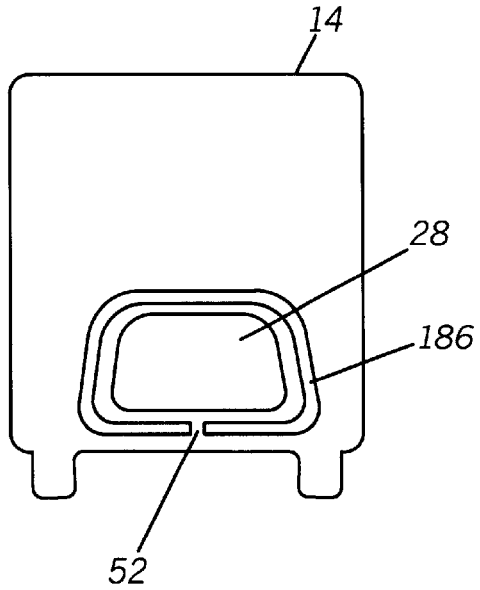
FIG. 6 is a representation of the flip 14 of FIG. 2 showing a fifth embodiment of the parasitic radiator 18.

Referring to FIG. 2, a simplified back-view of the communication device 10 is represented to show the different variations contemplated by the teachings of the present invention for the parasitic element 18 of FIGS. 3–6. The parasitic radiator or element 18 or 183–186 (FIGS. 3–6) is a quarterwave or a half-wavelength element, at the operating frequency of the antenna 16. Electrically, the parasitic radiator 18 is preferably a self-resonating metallic strip line which is plate or patch shaped in physical dimensions sufficient to result in an appropriate surface impedance which is directly proportional to the incident tangential field and inversely proportional to the amplitude of the surface current density of the surface of the plate. Because of the self resonance of the antenna array and proper coupling of elements 16 and 18, there is no need for a direct connection for the element 18. In addition to the aforementioned benefits, the strip line 18 will still contribute to the overall radiation of the antenna 16 to increase the overall antenna system gain.

The parasitic radiator 18 could be implemented as a metallized layer of paint, a metal plate or patch, on the inside or outside surfaces or within the flip 14 to form the self-resonating metallic strip line. Alternatively, the radiator 18 may be implemented as a metallized layer of paint in the form of a self resonance element. Due to the presence of the electric field, this element does not need a direct feed point. In this case, even though the parasitic radiator 18 does not need to be grounded, it could be optionally grounded at one end, or anywhere along the path of the element 18, to a printed circuit board main ground point 48 in the housing 12.

The ground selection and shape variation of the parasitic element 18 are optimized during testing, depending on the actual type of phone used and the frequency of operation. To correspond with the outer contour or otherwise follow the periphery or other portions of the phone to result in a sufficient surface impedance, the parasitic radiator 18, 183 or 185 can be implemented as a U-shaped metallic patch. Alternatively, a substantially D-shaped metallic patch 184 or 186 corresponding to the outer contour of the flip 14 or corresponding to the outer contour of the display screen 28 may be used. Optional cuts or openings 52 may be used in the path to add capacitance. An optional center stub or other tabs 54 may be employed to allow for inductance tuning.

In summary, an antenna system takes benefit from the form factor of a communication device to accomplish improved performance. This improvement is realized by having multiple elements which combine to produce better radiation and gain performance.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A communication device, comprising:

a housing having a display;

a flip movable between a fist and second position, the second position begin positioned away from the housing at an obtuse angle, and further having a transparent window to allow viewing of the display when in the first position and further having a speaker;

an antenna being extendible from the housing at an acute angle with the flip; and a parasitic radiator located in the flip and capacitively coupled to the antenna at the acute angle.

2. The communication device of claim 1, wherein the antenna and the parasitic radiator have about the same resonant frequency.

3. The communication device of claim 1, wherein the antenna and the parasitic radiator each comprise a multiple of a quarter or a half of a wavelength.

4. The communication device of claim 1, wherein the parasitic radiator operates as an escape route for the highly excited currents on the housing to flow into for reducing hand proximity effects when a user's hand is holding the housing.

5. The communication device of claim 1, wherein both the antenna and the parasitic radiator operate in an incident electric (E) field mode as a resultant of a two element antenna array effect.

6. The communication device of claim 1, wherein the obtuse angle is between a range of 145 to 155 degrees.

7. The communication device of claim 1, wherein the parasitic radiator comprises a self-resonating metallic strip line having a surface impedance directly proportional to the incident tangential field and inversely proportional to the amplitude of the surface current density of the surface of the parasitic radiator.

8. The communication device of claim 7, wherein the self-resonating metallic strip line comprises a metallized layer of paint in the form of a self-resonance element without a direct connection to a feedpoint source.

9. The communication device of claim 7, wherein the self-resonating metallic strip line comprises a plate shaped to have an appropriate surface impedance which is directly proportional to the incident tangential field and inversely proportional to the amplitude of the surface current density of the surface of the plate.

10. The communication device of claim 1, wherein the antenna and the parasitic radiator radiate together to provide an antenna array.

11. The communication device of claim 1, wherein the parasitic radiator has a shape following the periphery of the flip.

12. The communication device of claim 1, wherein the flip and the housing are rotatably mounted in a clam-style arrangement.

13. The communication device of claim 1, wherein the communication device comprises a phone.

14. The communication device of claim 1, wherein the parasitic radiator comprises a U shaped metallic patch corresponding to the outer contour of the flip.

15. The communication device of claim 1, wherein the parasitic radiator comprises a substantially D shaped metallic patch corresponding to the outer contour of the flip.

16. The communication device of claim 1, wherein the parasitic radiator comprises a substantially D shaped metallic patch corresponding to the outer contour of a display opening of the flip.

* * * * *